US010774405B2

(12) United States Patent
Hayashi et al.

(10) Patent No.: US 10,774,405 B2
(45) **Date of Patent: *Sep. 15, 2020**

(54) STEEL AND METHOD OF MANUFACTURING THE SAME

(71) Applicant: NIPPON STEEL & SUMITOMO METAL CORPORATION, Tokyo (JP)

(72) Inventors: Koutarou Hayashi, Osaka (JP); Akira Seki, Ashiya (JP); Kazuya Mishio, Sanda (JP); Shuhei Shimokawa, Nara (JP)

(73) Assignee: NIPPON STEEL CORPORATION, Tokyo (JP)

( * ) Notice: Subject to any disclaimer, the term of this patent is extended or adjusted under 35 U.S.C. 154(b) by 307 days.

This patent is subject to a terminal disclaimer.

(21) Appl. No.: 15/109,586

(22) PCT Filed: Jan. 6, 2014

(86) PCT No.: PCT/JP2014/050022

§ 371 (c)(1),
(2) Date: Jul. 1, 2016

(87) PCT Pub. No.: WO2015/102050

PCT Pub. Date: Jul. 9, 2015

(65) Prior Publication Data

US 2016/0333448 A1 Nov. 17, 2016

(51) Int. Cl.
*C21D 8/02* (2006.01)
*C21D 8/04* (2006.01)
(Continued)

(52) U.S. Cl.
CPC ..... *C22C 38/38* (2013.01); *C21D 6/004* (2013.01); *C21D 6/005* (2013.01); *C21D 6/008* (2013.01); *C21D 9/0068* (2013.01); *C21D 9/46* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/26* (2013.01); *C22C 38/28* (2013.01); *C22C 38/34* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C22C 38/04; C22C 38/02; C22C 38/001; C22C 38/06; C22C 38/002; C22C 38/12; C22C 38/14; C22C 38/005; C22C 38/38; C22C 38/22; C22C 38/28; C22C 38/44; C22C 38/08; C22C 38/16; C22C 38/18; C22C 38/32; C22C 38/42; C22C 38/58; C22C 38/24; C22C 38/26; C22C 38/00; C22C 38/50; C22C 38/48; C22C 38/46; C22C 38/34; C22C 38/54; C22C 38/40; C22C 38/20; C22C 2202/00; C21D 8/0226; C21D 8/0263; C21D 8/0205; C21D 8/0236; C21D 8/0273; C21D 8/0426; C21D 8/0473; C21D 8/0405; C21D 8/0447; C21D 8/1233; C21D 8/0436; C21D 8/0463; C21D 8/105; C21D 8/065; C21D 6/005; C21D 6/004; C21D 6/008; C21D 6/002; C21D 6/001; C21D 6/00; C21D 6/02; C21D 1/18; C21D 1/06; C21D 1/20; C21D 1/25; C21D 1/84; C21D 9/085; C21D 9/00; C21D 9/46; C21D 2211/008; C21D 2211/001; C21D 2211/00; B21D 22/022; B21D 35/005
USPC ..... 148/330, 333, 332, 320, 336, 334, 335, 148/504, 331, 337, 654, 318, 593, 319, 148/579, 664, 428, 506, 611, 644, 660, 148/66
See application file for complete search history.

(56) References Cited

U.S. PATENT DOCUMENTS 4,854,976 A 8/1989 Era et al.
6,454,881 B1 9/2002 Hase et al.
(Continued)

FOREIGN PATENT DOCUMENTS

CA 2770585 A1 2/2011
CA 2923582 A1 3/2015
(Continued)

OTHER PUBLICATIONS

Korean Notice of Preliminary Rejection dated Apr. 27, 2017, for Korean Application No. 10-2016-7017724, with English translation.
(Continued)

*Primary Examiner* — Matthew E. Hoban
*Assistant Examiner* — Lynne Edmondson
(74) *Attorney, Agent, or Firm* — Birch, Stewart, Kolasch & Birch, LLP

(57) ABSTRACT

Steel has a chemical composition that contains 0.050% to 0.40% of C, 0.50% to 3.0% of Si, 3.0% to 8.0% of Mn, and 0.001% to 3.0% of sol. Al, by mass %, and has a metallographic structure that contains 10% to 40% of austenite in terms of % by volume. The average concentration of C in austenite is 0.30% by 0.60%, by mass %, structure uniformity, which is represented by a value obtained by subtracting the minimum value from the maximum value of Vickers hardness that is measured, in the metallographic structure is 30 Hv or less, and the tensile strength is 900 MPa to 1800 MPa.

1 Claim, No Drawings

(51) Int. Cl.

| | |
|---|---|
| ***C21D 8/12*** | (2006.01) |
| ***C21D 6/00*** | (2006.01) |
| ***C21D 6/02*** | (2006.01) |
| ***C21D 1/18*** | (2006.01) |
| ***C22C 38/38*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/26*** | (2006.01) |
| ***C22C 38/28*** | (2006.01) |
| ***C22C 38/34*** | (2006.01) |
| ***C21D 9/46*** | (2006.01) |
| ***C22C 38/14*** | (2006.01) |
| ***C21D 9/00*** | (2006.01) |
| ***C22C 38/16*** | (2006.01) |

(56) References Cited

U.S. PATENT DOCUMENTS

| | | | | |
|---|---|---|---|---|
| 2004/0238082 | A1 | 12/2004 | Hasegawa et al. | |
| 2008/0308194 | A1 | 12/2008 | Corquillet et al. | |
| 2009/0098408 | A1 | 4/2009 | Sun | |
| 2009/0311125 | A1 | 12/2009 | Miyanishi et al. | |
| 2010/0000636 | A1 | 1/2010 | Bonnefois et al. | |
| 2011/0146852 | A1 | 6/2011 | Matsuda et al. | |
| 2011/0198002 | A1* | 8/2011 | Nakagaito | C22C 38/02 148/533 |
| 2011/0308673 | A1 | 12/2011 | Schneider et al. | |
| 2011/0315279 | A1* | 12/2011 | Kaneko | C21D 6/005 148/533 |
| 2012/0012231 | A1 | 1/2012 | Murakami et al. | |
| 2012/0186707 | A1 | 7/2012 | Hirasawa et al. | |
| 2012/0211128 | A1 | 8/2012 | Corquillet et al. | |
| 2012/0291928 | A1 | 11/2012 | Celotto | |
| 2013/0095347 | A1* | 4/2013 | Kawasaki | B32B 15/013 428/684 |
| 2013/0133792 | A1 | 5/2013 | Nakagaito et al. | |
| 2014/0050941 | A1 | 2/2014 | Kawasaki et al. | |
| 2014/0096876 | A1 | 4/2014 | Matsuda et al. | |
| 2014/0205488 | A1 | 7/2014 | Jun et al. | |
| 2014/0212684 | A1 | 7/2014 | Kawata et al. | |
| 2014/0234660 | A1 | 8/2014 | Kawata et al. | |
| 2014/0308156 | A1* | 10/2014 | Oh | C21D 8/02 420/73 |
| 2015/0030880 | A1 | 1/2015 | Kosaka et al. | |
| 2015/0034037 | A1 | 2/2015 | Qiao et al. | |

FOREIGN PATENT DOCUMENTS

| | | | |
|---|---|---|---|
| CA | 2923583 | A1 | 3/2015 |
| CA | 2923585 | A1 | 3/2015 |
| CA | 2933435 | A1 | 6/2015 |
| CA | 2934597 | A1 | 7/2015 |
| CA | 2934599 | A1 | 7/2015 |
| CA | 2935638 | A1 | 7/2015 |
| CN | 1380911 | A | 11/2002 |
| CN | 101292049 | A | 10/2008 |
| CN | 101542004 | A | 9/2009 |
| CN | 101638749 | A | 2/2010 |
| CN | 102149840 | A | 8/2011 |
| CN | 102282280 | A | 12/2011 |
| CN | 102906291 | A | 1/2013 |
| CN | 103502496 | A | 1/2014 |
| CN | 103717773 | A | 4/2014 |
| EP | 1767659 | A1 | 3/2007 |
| EP | 2 371 978 | A1 | 10/2011 |
| EP | 2778247 | A1 | 9/2014 |
| EP | 2824204 | A1 | 1/2015 |
| EP | 3075872 | A1 | 10/2016 |
| GB | 1 490 535 | A | 11/1977 |
| JP | 7-3328 | A | 1/1995 |
| JP | 10-96031 | A | 4/1998 |
| JP | 2003-138345 | A | 5/2003 |
| JP | 2004-269920 | A | 9/2004 |
| JP | 2005-139485 | A | 6/2005 |
| JP | 2005-205477 | A | 8/2005 |
| JP | 2005-248320 | A | 9/2005 |
| JP | 2006-70346 | A | 3/2006 |
| JP | 2006-131958 | A | 5/2006 |
| JP | 2007-327123 | A | 12/2007 |
| JP | 2009-508692 | A | 3/2009 |
| JP | 2010-65292 | A | 3/2010 |
| JP | 2010-65295 | A | 3/2010 |
| JP | 2010-90475 | A | 4/2010 |
| JP | 2010-126770 | A | 6/2010 |
| JP | 2010-150612 | A | 7/2010 |
| JP | 2010-196115 | A | 9/2010 |
| JP | 2011-184758 | A | 9/2011 |
| JP | 2011-195956 | A | 10/2011 |
| JP | 2012-180594 | A | 9/2012 |
| JP | 2012-237054 | A | 12/2012 |
| JP | 2013-163827 | A | 8/2013 |
| JP | 2013-185243 | A | 9/2013 |
| JP | 2014-19941 | A | 2/2014 |
| JP | 2014-25091 | A | 2/2014 |
| JP | 2014-47395 | A | 3/2014 |
| JP | 6098733 | B | 3/2017 |
| KR | 2013-0140183 | A | 12/2013 |
| KR | 2014-0052072 | A | 5/2014 |
| RU | 2 451 764 | C2 | 8/2011 |
| RU | 2 499 847 | C2 | 2/2012 |
| WO | WO 2012/147898 | A1 | 11/2012 |
| WO | WO 2013/047821 | A1 | 4/2013 |
| WO | WO 2013/061545 | A1 | 5/2013 |
| WO | WO 2013/069937 | A1 | 5/2013 |
| WO | WO-2013069937 | A1 * | 5/2013 ..... C21D 8/02 |
| WO | WO 2013/105633 | A1 | 7/2013 |
| WO | WO 2013/125400 | A1 | 8/2013 |
| WO | WO 2013/129049 | A1 | 9/2013 |
| WO | WO 2013/133165 | A1 | 9/2013 |
| WO | WO 2015/102051 | A1 | 7/2015 |

OTHER PUBLICATIONS

Extended European Search Report for counterpart European Application No. 14876061.4, dated Jun. 28, 2017.

Chinese Office Action and Search Report, dated Feb. 22, 2017, for counterpart Chinese Application No. 201480072212.9, with an English translation of the Search Report.

International Search Report for PCT/JP2014/050022 dated Mar. 25, 2014.

Office Action for TW 103100367 dated Jan. 12, 2015.

Written Opinion of the International Searching Authority for PCT/JP2014/050022 (PCT/ISA/237) dated Mar. 25, 2014.

Canadian Office Action issued in Canadian Application No. 2,935,308, dated Apr. 18, 2017.

Chinese Office Action and Search Report dated Mar. 6, 2017, for Chinese Application No. 201480072216.7, with an English translation.

Chinese Office Action dated Nov. 1, 2017, issued in Chinese Patent Application No. 201580037612.0.

Extended European Search Report issued in European Application No. 14876913.6 dated Jul. 25, 2017.

Furukawa et al., "Journal of the Japan Society for Heat Treatment", 1997, vol. 37, No. 4, pp. 204-211, total 21 pages.

International Preliminary Report on Patentability for PCT/JP2015/070566, dated Feb. 2, 2017 (Forms PCT/IB/338, PCT/IB373 and PCT/ISA/237).

International Search Report for PCT/JP2014/050027 dated Apr. 8, 2014.

International Search Report for PCT/JP2015/070566 (PCT/ISA/210) dated Oct. 13, 2015.

Korean Office Action dated May 9, 2018, issued in Korean Patent Application No. 10-2017-7000832.

(56) References Cited

OTHER PUBLICATIONS

Korean Office Action issued in Korean Application No. 10-2016-7018726, dated Apr. 27, 2017, together with an English translation.
Notice of Allowance dated Nov. 23, 2017, in Korean Patent Application No. 10-2016-7018726, with English translation.
Office Action for TW 103100371 dated Mar. 16, 2015.
Office Action dated Jan. 30, 2018, in Russian Patent Application No. 2016128754/02, with English translation.
U.S. Office Action for U.S. Appl. No. 15/109,322, dated Jul. 6, 2018.
Written Opinion of the International Searching Authority for PCT/JP2014/050027 (PCT/ISA/237) dated Apr. 8, 2014.
Written Opinion of the International Searching Authority for PCT/JP2015/070566 (PCT/ISA/237) dated Oct. 13, 2015.
Indonesia Office Action dated Jan. 23, 2019, issued in Indonesia Patent Application No. P00201604582.

* cited by examiner

STEEL AND METHOD OF MANUFACTURING THE SAME

TECHNICAL FIELD OF THE INVENTION

The present invention relates to ultrahigh-strength steel such as steel for a vehicle, steel for an oil well pipe, and steel for building construction which are suitable for use when ductility is indispensable, and a method of manufacturing the steel. Specifically, the present invention relates to ultrahigh-strength steel in which a tensile strength is 900 MPa or greater, and which has excellent ductility and excellent impact characteristics, and a method of manufacturing the steel.

RELATED ART

Recently, development of a material, which contributes to energy saving, has been required from the viewpoint of global environment protection. In fields of steel for a vehicle, steel for an oil well pipe, steel for building construction, and the like, a demand for reduction in weight of steel and a demand for ultrahigh-strength steel, which can be applied to a reduction in weight of steel and a harsh usage environment, have increased, and thus an application range thereof has been expanded. As a result, it is important for the ultrahigh-strength steel that is used in the fields to secure not only strength characteristics but also safety in a usage environment. Specifically, it is important to increase the tolerance with respect to an external plastic deformation by increasing the ductility of steel.

For example, in a case where a vehicle collides with a structure body, it is necessary that the tensile strength of steel is 900 MPa or greater, and a value (TS×EL) of the product of the tensile strength (TS) and the total elongation (EL) is 24000 MPa·% or greater in order to sufficiently mitigate an impact by using an anti-collision member of the vehicle. However, along with an increase in the tensile strength, the ductility significantly decreases, and thus there is no ultrahigh-strength steel which satisfies the above-described characteristics and of which industrial mass production is possible. Accordingly, various kinds of research and development have been conducted so as to improve the ductility of the ultrahigh-strength steel, and suggested microstructure control methods for realization of the improvement have been suggested.

For example, Patent Document 1 discloses that with respect to steel which contains 1.2% to 1.6% of Si (in this specification, % relating to a chemical composition of steel represents mass %), and approximately 2% of Mn, a metallographic structure is controlled by optimizing a heating temperature and a retention condition of austempering so that approximately 10% of austenite is contained in steel, and thus steel having a tensile strength of 80 kg/mm$^2$ (784 MPa) or greater and excellent ductility is obtained.

Patent Document 2 discloses that steel, which contains 0.17% or greater of C, and 1.0% to 2.0% of Si and Al in a total amount, and approximately 2% of Mn, is heated to a temperature region of an austenite single phase, is rapidly cooled down to a temperature range of 50° C. to 300° C., and is heated again to control a metallographic structure of steel so that both martensite and austenite are contained in steel, and thus steel having a tensile strength of 980 MPa or greater and excellent ductility is obtained.

Patent Document 3 discloses that steel, which contains 0.10% of C, 0.1% of Si, and 5% of Mn, is heat-treated at a temperature of $A_1$ point or lower, and thus steel, in which the value of the product of the tensile strength and the elongation is significantly high, is obtained.

PRIOR ART DOCUMENT

Patent Document

Patent Document 1: Japanese Unexamined Patent Application, First Publication No. 2004-269920

Patent Document 2: Japanese Unexamined Patent Application, First Publication No. 2010-90475

Patent Document 3: Japanese Unexamined Patent Application, First Publication No. 2003-138345

DISCLOSURE OF THE INVENTION

Problems to be Solved by the Invention

As described above, several technologies which provide ultrahigh-strength steel having excellent ductility are suggested. However, as described below, none of the technologies can be said to be sufficient.

In the technology disclosed in Patent Document 1, the tensile strength of steel cannot be set to 900 MPa or greater. The reason for this is as follows. In the technology disclosed in Patent Document 1, generation of ferrite is promoted during heating and cooling down to 600° C. so as to enhance stability of austenite that is contained in steel. If ferrite is generated, the tensile strength of steel significantly decreases. Accordingly, the technology disclosed in Patent Document 1 cannot be applied to steel in which a tensile strength of 900 MPa or greater is required.

In the technology disclosed in Patent Document 2, material stability with respect to the manufacturing method is deficient, and thus safety of a structure body, to which the obtained steel is applied, is not secured. That is, in the technology disclosed in Patent Document 2, the tensile strength is controlled in accordance with heat treatment conditions after rapid cooling, specifically, a cooling rate, a cooling stopping temperature (a temperature at which cooling is stopped), and reheating conditions. However, similar to Patent Document 2, in a case where the cooling rate is set to 8° C./second or faster, and steel, which is heated, is cooled down to a temperature range of 50° C. to 300° C., a temperature distribution in steel becomes extremely non-uniform due to transformation heat generation and the like. That is, the technology disclosed in Patent Document 2 has a problem in that control of the cooling rate and the cooling stopping temperature is very difficult. In a case where the temperature distribution during cooling is non-uniform, the strength distribution of steel becomes extremely non-uniform, and thus safety of a structure body, to which steel is applied, is not secured due to early fracture of a weak low-strength portion. According to this, the technology disclosed in Patent Document 2 is deficient in material stability, and cannot be applied to steel in which safety is necessary.

A product (steel), which is obtained by the technology disclosed in Patent Document 3, is deficient in impact characteristics, and thus safety of a structure body, to which steel is applied, is not secured. That is, in the technology disclosed in Patent Document 3, Mn segregation is used, and thus a large amount of austenite is generated during heat in a temperature region of $A_1$ point or lower. On the other hand, a large amount of coarse cementite precipitates due to heating at a temperature of $A_1$ point or lower, and thus local stress concentration is likely to occur during deformation.

Due to the stress concentration, austenite, which is contained in steel, is transformed into martensite at an early time of impact deformation, and thus voids are generated at the periphery of martensite. As a result, impact characteristics of steel decrease. Accordingly, steel, which is obtained by the technology disclosed in Patent Document 3, is deficient in the impact characteristics, and cannot be used as steel in which safety is necessary.

As described above, several technologies which provide ultrahigh-strength steel which has a tensile strength of 900 MPa or greater, and is excellent in ductility are suggested. However, steel in the technologies is deficient in material stability or impact characteristics, and thus it cannot be said that the material stability and the impact characteristics are sufficient.

The present invention has been made to solve the above-described problem, and an object thereof is to provide ultrahigh-strength steel that has excellent ductility and excellent impact characteristics while having a tensile strength of 900 MPa or greater, and a method of manufacturing the steel.

Here, the "excellent ductility" represents that a value of the product of the tensile strength and the total elongation is 24000 MPa·% or greater. In addition, the "excellent impact characteristics" represent that an impact value in a Charpy test at 0° C. is 20 J/cm$^2$ or greater.

Solution to Problem

The present inventors have extensively studied to solve the above-described problem. As a result, the following new findings are obtained. Specifically, with regard to a chemical composition of steel, it is important to contain a large amount of Si and Mn. In addition, with regard to a manufacturing method, it is important to apply heat treatment conditions which are optimal to base steel having the chemical composition. In addition, with regard to the base steel that is subjected to a heat treatment, it is important to make the structure thereof be composed of a fine martensite single phase. As described above, by controlling the material and the heat treatment conditions, it is possible to stably manufacture ultrahigh-strength steel which cannot be manufactured in the related art and which has excellent ductility and excellent impact characteristics while having a tensile strength of 900 MPa or greater. The present invention has been made on the basis of the finding, and the gist of the present invention is as follows.

(1) An aspect of the present invention is a steel that has a chemical composition, by mass %, 0.050% to 0.40% of C, 0.50% to 3.0% of Si, 3.0% to 8.0% of Mn, 0.001% to 3.0% of sol. Al, 0.05% or less of P, 0.01% or less of S, 0.01% or less of N, 0% to 1.0% of Ti, 0% to 1.0% of Nb, 0% to 1.0% of V, 0% to 1.0% of Cr, 0% to 1.0% of Mo, 0% to 1.0% of Cu, 0% to 1.0% of Ni, 0% to 0.01% of Ca, 0% to 0.01% of Mg, 0% to 0.01% of REM, 0% to 0.01% of Zr, 0% to 0.01% of B, 0% to 0.01% of Bi, and the remainder including Fe and impurities, wherein a metallographic structure contains 10% to 40% of austenite in terms of % by volume, an average concentration of C in the austenite is 0.30% to 0.60%, by mass %, structure uniformity, which is represented by a value obtained by subtracting the minimum value from the maximum value of Vickers hardness that is measured, in the metallographic structure is 30 Hv or less, and a tensile strength is 900 MPa to 1800 MPa.

(2) In the steel according to (1), the chemical composition may contain one or two or more selected from the group consisting of 0.003% to 1.0% of Ti, 0.003% to 1.0% of Nb, 0.003% to 1.0% of V, 0.01% to 1.0% of Cr, 0.01% to 1.0% of Mo, 0.01% to 1.0% of Cu, and 0.01% to 1.0% of, by mass %.

(3) In the steel according to (1) or (2), the chemical composition may contain one or two or more selected from the group consisting of 0.0003% to 0.01% of Ca, 0.0003% to 0.01% of Mg, 0.0003% to 0.01% of REM, 0.0003% to 0.01% of Zr, and 0.0003% to 0.01% of B, by mass %.

(4) In the steel according to any one of (1) to (3), the chemical composition may contain 0.0003% to 0.01% of Bi, by mass %.

(5) In the steel according to any one of (1) to (4), the chemical composition may contain 4.0% to 8.0% of Mn, by mass %.

(6) Another aspect of the present invention provides a method of manufacturing a steel, the method includes performing a heat treatment with respect to base steel having the chemical composition according to any one of (1) to (5), and a metallographic structure in which an average grain size of a prior austenite is 20 μm or less and which is composed of a martensite single phase, wherein the heat treatment includes a retention process of retaining the base steel at a temperature that is equal to or higher than 670° C. and lower than 780° C., and is lower than an $Ac_3$ point for 5 seconds to 120 seconds, and a cooling process of cooling the base steel in such a manner that an average cooling rate from the temperature region to 150° C. is 5° C./second to 500° C./second after the retention process.

Effects of the Invention

According to the present invention, it is possible to manufacture ultrahigh-strength steel that is excellent in ductility and impact characteristics while having a high tensile strength of 900 MPa or greater. The ultrahigh-strength steel according to the present invention can be widely used in an industrial field, particularly, a vehicle field, an energy field, a building field, and the like. Furthermore, in a case where the tensile strength is too high, low-temperature toughness may deteriorate, and thus it is preferable that the tensile strength of steel is 1800 MPa or less.

EMBODIMENT OF THE INVENTION

Hereinafter, steel according to an embodiment of the present invention will be described in detail.

1. Chemical Composition

A chemical composition of steel (ultrahigh-strength steel having excellent ductility and excellent impact characteristics) according to this embodiment is as follows. As described above, "%", which represents the amount of each element in this embodiment, is mass %.

C: 0.050% to 0.40%

C is an element that promotes generation of austenite, and contributes an increase in strength and an improvement in ductility. The lower limit of the amount of C is set to 0.050% in order to set the tensile strength of steel to 900 MPa or greater, and in order to set a value (TS×EL) of the product of the tensile strength and the elongation of steel to 24000 MPa·% or greater. When the amount of C is set to 0.080% or greater while controlling other elements in an appropriate range, the tensile strength becomes 1000 MPa or greater. Accordingly, it is preferable that the amount of C is set to 0.080% or greater. However, when the amount of C is greater than 0.40%, impact characteristics deteriorate.

According to this, the upper limit of the amount of C is set to 0.40%. The upper limit of the amount of C is preferably 0.25%.

Si: 0.50% to 3.0%

Si is an element that promotes generation of austenite, and contributes to an improvement in ductility. The lower limit of the amount of Si is set to 0.50% in order to set the value of the product of the tensile strength and the total elongation of steel to 24000 MPa·% or greater. When the amount of Si is set to 1.0% or greater, weldability is improved. Accordingly, it is preferable that the lower limit of the amount of Si is set to 1.0%. However, when the amount of Si is greater than 3.0%, the impact characteristics deteriorate. Accordingly, the upper limit of the amount of Si is set to 3.0%.

Mn: 3.0% to 8.0%

Mn is an element that promotes generation of austenite, and contributes to an increase in strength and an improvement in ductility. When the amount of Mn is set to 3.0% or greater, non-uniformity of a structure, which is caused by Mn micro-segregation, decreases, and thus austenite is uniformly distributed. As a result, it is possible to set the tensile strength of steel to 900 MPa or greater, and it is possible to set the value of the product of the tensile strength and the total elongation of steel to 24000 MPa·% or greater. Accordingly, the lower limit of the amount of Mn is set to 3.0%. Furthermore, in a case where the amount of C is 0.40% or less, when the amount of Mn is set to 4.0% or greater, stability of austenite increases and work hardening persists, and thus the tensile strength becomes 1000 MPa or greater. Accordingly, it is preferable that the lower limit of the amount of Mn is set to 4.0%. However, when the amount of Mn is greater than 8.0%, refining and casting in a converter becomes significantly difficult. According to this, the upper limit of the amount of Mn is set to 8.0%. The upper limit of the amount of Mn is preferably 6.5%.

P: 0.05% or Less

P is an element that is contained as an impurity. However, P is also an element that contributes to an increase in strength, and thus P may be positively contained. However, when the amount of P is greater than 0.05%, casting becomes significantly difficult. According to this, the upper limit of the amount of P is set to 0.05%. The upper limit of the amount of P is preferably 0.02%.

The lower the amount of P is, the more preferable. Accordingly, the lower limit of the amount of P is 0%. However, the lower limit of the amount of P may be set to 0.003% from the viewpoints of manufacturing cost and the like.

S: 0.01% or Less

S is an element that is contained as an impurity, and significantly deteriorates the impact characteristics of steel. According to this, the upper limit of the amount of S is set to 0.01%. The upper limit of the amount of S is preferably 0.005%, and more preferably 0.0015%.

The lower the amount of S is, the more preferable. Accordingly, the lower limit of the amount of S is 0%. However, the lower limit of the amount of S may be set to 0.0003% from the viewpoints of manufacturing cost and the like.

Sol. Al: 0.001% to 3.0%

Al is an element that has an effect on deoxidizing steel. The lower limit of the amount of sol. Al is set to 0.001% for soundness of steel. The lower limit of the amount of sol. Al is preferably 0.010%. On the other hand, when the amount of sol. Al is greater than 3.0%, casting becomes significantly difficult. According to this, the upper limit of the amount of sol. Al is set to 3.0%. The upper limit of the amount of sol. Al is preferably 1.2%. The amount of sol. Al represents the amount of Al that is soluble to acid in steel.

N: 0.01% or Less

N is an element that is contained as an impurity, and significantly deteriorates aging resistance of steel. Accordingly, the upper limit of the amount of N is set to 0.01%. The upper limit of the amount of N is preferably 0.006%, and more preferably 0.003%. The lower the amount of N is, the more preferable. Accordingly, the lower limit of the amount of N is 0%. However, the lower limit of the amount of N may be set to 0.001% from the viewpoints of manufacturing cost and the like.

One or Two or More Selected from Group Consisting of Ti: 1.0% or Less, Nb: 1.0% or Less, V: 1.0% or Less, Cr: 1.0% or Less, Mo: 1.0% or Less, Cu: 1.0% or Less, and Ni: 1.0% or Less The elements are elements which are effective to stably secure the strength of steel. Accordingly, one or two or more of the elements may be contained. However, when the amount of any of the element is greater than 1.0%, it is difficult to perform hot working of steel. According to this, the amount of each of the elements in the case of being contained is set as described above. It is not necessary for the elements to be contained. Accordingly, it is not necessary to particularly limit the lower limit of the amount of the elements, and the lower limit is 0%.

Furthermore, it is preferable to satisfy at least one of Ti: 0.003% or greater, Nb: 0.003% or greater, V: 0.003% or greater, Cr: 0.01% or greater, Mo: 0.01% or greater, Cu: 0.01% or greater, and Ni: 0.01% or greater so as to more reliably obtain the effect of the elements.

One or Two or More Selected from Group Consisting of Ca: 0.01% or Less, Mg: 0.01% or Less, REM: 0.01% or Less, Zr: 0.01% or Less, and B: 0.01% or Less The elements are elements having an effect on increasing low-temperature toughness. Accordingly, one or two or more of the elements may be contained. However, when any of the elements is contained in an amount of greater than 0.01%, a surface quality of steel deteriorates. According to this, the amount of each of the elements in a case of being contained is set as described above. It is not necessary for the elements to be contained. According to this, it is not necessary to particularly limit the lower limit of the amount, and the lower limit of the amount is 0%.

Furthermore, it is preferable to set the amount of at least one of the elements to 0.0003% or greater so as to more reliably obtain the effect of the elements. Here, REM represents total 17 elements including Sc, Y, and lanthanoids, and the amount of REM represents the total amount of these elements. Industrially, the lanthanoids are added in a type of a misch metal.

Bi: 0.01% or Less

Bi is an element that reduces segregation of Mn, and mitigates anisotropy of mechanical properties. Accordingly, Bi may be contained to obtain this effect. However, the amount of Bi is greater than 0.01%, it is difficult to perform hot-working of steel. According to this, the upper limit of the amount of Bi in a case of being contained is set to 0.01%. It is not necessary for Bi to be contained. According to this, it is not necessary to particularly limit the lower limit of the amount, and the lower limit is 0%.

Furthermore, it is preferable to set the amount of Bi to 0.0003% or greater so as to more reliably obtain the effect due to containing of Bi.

2. Metallographic Structure

The steel according to this embodiment has the chemical composition, and has a metallographic structure in which 10% to 40% of austenite is contained in terms of % by volume, and the average concentration of C in the austenite is 0.30% to 0.60%, by mass %. The metallographic structure can be obtained by applying the following manufacturing method to base steel having the above-described chemical composition.

Volume Ratio of Austenite: 10% to 40%

In a metallographic structure of steel having the above-described chemical composition, when the volume ratio of austenite is 10% or greater, a tensile strength of 900 MPa or greater and excellent ductility are obtained. When the volume ratio of austenite is less than 10%, an improvement in ductility is not sufficient. Accordingly, the lower limit of the volume ratio of austenite of the steel according to this embodiment is set to 10%. On the other hand, when the volume ratio of austenite is greater than 40%, delayed fracture resistance deteriorates. According to this, the upper limit of the volume ratio of austenite of the steel according to this embodiment is set to 40%.

Furthermore, it is preferable that a remaining structure other than austenite is martensite and ferrite is not contained in order to secure a tensile strength of 900 MPa or greater.

Average Concentration of C in Austenite: 0.30 Mass % to 0.60 Mass %

When the average concentration of C in austenite of steel having the above-described chemical composition is 0.30 mass % or greater, the impact characteristics of steel are improved. When the average concentration of C is less than 0.30 mass %, an improvement in the impact characteristics becomes not sufficient. Accordingly, the lower limit of the average concentration of C in austenite of the steel according to this embodiment is set to 0.30 mass %. On the other hand, in a case where the average concentration of C is greater than 0.60%, martensite, which is generated in accordance with a TRIP phenomenon, becomes full hard, and micro-cracks are likely to generate in the vicinity of the martensite, and thus impact characteristics deteriorate. According to this, the upper limit of the average concentration of C in austenite of the steel according to this embodiment is set to 0.60 mass %.

Structure Uniformity

In the metallographic structure of steel having the above-described chemical composition, when structure uniformity, which is represented by a difference (the maximum value−the minimum value) between the minimum value and the maximum value of the Vickers hardness that is measured, is 30 Hv or less, non-uniform deformation is suppressed, and thus good ductility is stably secured. Accordingly, the structure uniformity of steel according to this embodiment is set to 30 Hv or less. The smaller the difference between the maximum value and the minimum value of Vickers hardness is, the more preferable it is. Accordingly, the lower limit of the structure uniformity is 0.

Furthermore, the structure uniformity can be obtained as follows. Specifically, the hardness at five points is measured under a load of 1 kg by using a Vickers tester, and the difference between the maximum value and the minimum value of the Vickers hardness at that time is obtained as the structure uniformity.

3. Manufacturing Method

A description of a method (manufacturing method according to this embodiment) of manufacturing the steel according to this embodiment will be given.

As described above, in order to obtain ultrahigh-strength steel having a tensile strength of 900 MPa or greater and excellent ductility and excellent impact characteristics, it is important that in the metallographic structure after a heat treatment, 10% to 40% of austenite is contained in terms of % by volume, and the average concentration of C in austenite is set to 0.30% to 0.60%, by mass %. The above-described metallographic structure is obtained by performing the following heat treatment to steel, which has a chemical composition in the above-described range, and has a metallographic structure in which an average grain size of prior austenite is 20 μm or less and which is composed of a martensite single phase, as a material (base steel). Specifically, the metallographic structure is obtained by heating the base steel to a temperature region which is equal to or higher than 670° C. and lower than 780, and is lower than the $Ac_3$ point, by retaining the base steel in the temperature region for 5 seconds to 120 seconds (retention process), and by cooling down the base steel in such a manner that the average cooling rate from the temperature region to 150° C. is 5° C./second to 500° C./second (cooling process).

Furthermore, even when performing the heat treatment, the chemical composition of steel does not vary. That is, the chemical composition is not different between the steel (base steel) before the heat treatment and the steel according to this embodiment.

Metallographic Structure of Steel (Base Steel, that is, Steel Before Heat Treatment) Used in Heat Treatment.

As the steel that is subjected to the heat treatment, steel, which has the above-described chemical composition, and has the metallographic structure in which the average grain size of prior austenite is 20 μm or less and which is composed of a martensite single phase, is used. When the steel having the metallographic structure is subjected to a heat treatment under the following conditions, ultrahigh-strength steel, which has a high strength such as a tensile strength of 900 MPa or greater and is excellent in ductility and impact characteristics, is obtained.

In a case where the structure of steel that is subjected to the heat treatment is not composed of a martensite single phase, growth of austenite during the heat treatment is delayed, and thus the volume ratio of austenite after the heat treatment decreases. In addition, in a case where the structure of steel that is subjected to the heat treatment is not composed of a martensite single phase, in steel after the heat treatment, TS×EL decreases, and thus early fracture occurs during collision.

In a case where the average grain size of prior austenite is greater than 20 μm, localization of C in austenite becomes significant at an early period of reaction, and thus there is a concern that the average concentration of C in austenite exceeds 0.60 mass %.

For example, the steel (base steel), which has the above-described metallographic structure and is used in the heat treatment, can be manufactured by performing hot working with respect to steel such as a steel piece having the above-described chemical composition at a temperature of 850° C. or lower, and by rapidly cooling the steel to room temperature at a cooling rate of 20° C./second or faster, or by heating the steel at a temperature at which the metallographic structure becomes an austenite single phase after cold-working, and by rapidly cooling the steel to room temperature at a cooling rate of 20° C./second or faster. In a case where the average grain size of prior austenite is 20 μm or less, the steel may be subject to tempering.

Furthermore, retention may be performed at a steel piece stage at 1150° C. to 1350° C. for 0.5 hours to 10 hours in order to enhance the structure uniformity of the steel after the heat treatment.

Heating and Retention Conditions (Heat Treatment Conditions): Retention in Temperature Region That is Equal to or Higher than 670° C. and is Lower than 780° C., and is Lower than $Ac_3$ Point for 5 Seconds to 120 Seconds The base steel, which has the metallographic structure in which the average grain size of prior austenite is 20 μm or less and which is composed of a martensite single phase, is heated to a temperature region that is equal to or higher than 670° C. and is lower than 780° C., and is lower than the $Ac_3$ point (° C.), which is defined by the following Expression (1) and at which an austenite single phase is obtained, and is retained in the temperature region for 5 seconds to 120 seconds.

Here, the $Ac_3$ point is calculated with the following Expression (1) by using the amount of each element.

$$Ac_3=910-203\times(C^{0.5})-15.2\times Ni+44.7\times Si+104\times V+31.5\times Mo-30\times Mn-11\times Cr-20\times Cu+700\times P+400\times Al+50\times Ti \quad (1)$$

In Expression (1), each of the element symbols represents the amount of the element (unit: mass %) in the chemical composition of steel.

When the retention temperature is lower than 670° C., the average concentration of C in austenite, which is contained in steel after the heat treatment, becomes excessive. As a result, in steel after the heat treatment, impact characteristics deteriorate, and it is difficult to secure a tensile strength of 900 MPa or greater. Accordingly, the lower limit of the retention temperature is set to 670° C. On the other hand, when the retention temperature becomes 780° C. or higher, or the $Ac_3$ point or higher, an appropriate amount of austenite is not contained in steel after the heat treatment, and ductility significantly deteriorates. Accordingly, the retention temperature is set to be lower than 780° C. and be lower than the $Ac_3$ point. Here, the temperature, which is lower than 780° C. and is lower than the $Ac_3$ point represents a temperature lower than the $Ac_3$ point in a case where the $Ac_3$ point is lower than 780° C., and represents a temperature that is lower than 780° C. in a case where the $Ac_3$ point is 780° C. or higher.

On the other hand, when the retention time is shorter than 5 seconds, a temperature distribution remains in steel, and thus it is difficult to stably secure tensile strength after the heat treatment. Accordingly, the lower limit of the retention time is set to 5 seconds. On the other hand, when the retention time is longer than 120 seconds, the average concentration of C in austenite that is contained in steel after the heat treatment becomes excessively small, and thus impact characteristics deteriorate. Accordingly, the upper limit of the retention time is set to 120 seconds. Furthermore, when the steel is heated to a temperature that is equal to or higher than 670° C. and is lower than 780° C., and is lower than the $Ac_3$ point, and is retained in the temperature region for 5 seconds to 120 seconds, it is preferable to set the average heating rate to 0.2° C./second to 100° C./second. When the average heating rate is slower than 0.2° C./second, productivity deteriorates. On the other hand, in a case of using a typical furnace, when the average heating rate is faster than 100° C./second, it is difficult to control the retention temperature. However, in a case of using high-frequency heating, even when performing heating at a temperature-increasing rate that is faster than 100° C./second, the above-described effect can be obtained.

Average Cooling Rate (Heat Treatment Condition) from Retention Temperature Region During Heating to 150° C.: 5° C./Second to 500° C./Second After the above-described heating and retention, cooling is performed in such a manner that an average cooling rate from the heating and retention temperature region to 150° C. becomes 5° C./second to 500° C./second. When the average cooling rate is slower than 5° C./second, soft ferrite or pearlite is excessively generated, and thus it is difficult to secure a tensile strength of 900 MPa or greater in steel after the heat treatment. Accordingly, the lower limit of the average cooling rate is set to 5° C./second. On the other hand, when the average cooling rate is faster than 500° C./second, a quenching crack is likely to occur. Accordingly, the upper limit of the average cooling rate is set to 500° C./second. Furthermore, as long as the average cooling rate up to 150° C. is set to 5° C./second to 500° C./second, the cooling rate at a temperature of 150° C. or lower may be the same as the range, or may be different from the range.

According to the manufacturing method according to this embodiment, it is possible to manufacture ultrahigh-strength steel having a metallographic structure which contains 10% to 40% of austenite in terms of % by volume and in which an average concentration of C in austenite is 0.30% to 0.60%, by mass %, and having a tensile strength of 900 MPa or greater and having excellent ductility and impact characteristics.

EXAMPLES

Base steel having a chemical composition shown in Table 1 and a metallographic structure shown in Table 2 is used in a heat treatment under conditions shown in Table 3.

The base steel, which was used, was prepared by subjecting slab that was obtained through melting in a laboratory to hot working. The base steel was cut into dimensions of 3 mm (thickness), 100 mm (width), and 200 mm (length), and was heated, retained, and cooled under conditions in Table 3. A thermocouple was attached to a surface of the steel to perform temperature measurement during a heat treatment. In Table 3, the average heating rate represents a value in a temperature region from room temperature to a heating temperature, a retention time represents time taken for retention at the heating temperature, and the average cooling rate represents a value in a temperature region from a retention temperature to 150° C. As described below, a metallographic structure of metal that was used in the heat treatment, and the metallographic structure and the mechanical properties of steel that was obtained through the heat treatment were investigated through metallographic structure observation, X-ray diffraction measurement, a tensile test, and a Charpy test. Test results are shown in Table 4.

(Metallographic Structure of Steel (Base Steel) that is Subjected to Heat Treatment)

A cross-section of steel, which was used in the heat treatment, was observed and photographed with an electron microscope, and a total region of 0.04 $mm^2$ was analyzed to identify a metallographic structure and to measure an average grain size of prior austenite. The average grain size of prior austenite was obtained by measuring the average slice length in the observed image that was obtained, and by multiplying the length by 1.78.

An observation position was set to a position that avoids the central segregation portion at a position (position of ½t) of approximately ½ times the sheet thickness. The reason for avoiding the central segregation portion is as follows. The central segregation portion may have a metallographic structure that is locally different from a representative metallographic structure of steel. However, the central segregation portion is a minute region with respect to the entirety of the sheet thickness, and hardly has an effect on the characteristics of steel. That is, it cannot be said that the metallographic structure of the central segregation portion represents a metallographic structure of steel. According to this, it is preferable to avoid the central segregation portion in identification of the metallographic structure.

(Volume Ratio of Austenite in Steel after Heat Treatment)

A test specimen having a width of 25 mm and a length of 25 mm was cut out from the steel after the heat treatment, the test specimen was subjected to chemical polishing so as to reduce the thickness by 0.3 mm, and X-ray diffraction was performed three times with respect to a surface of the test specimen after the chemical polishing. Profiles, which were obtained, were analyzed, and were averaged to calculate the volume ratio of austenite.

(Average Concentration of C in Austenite in Steel after Heat Treatment)

The profiles, which were obtained in the X-ray diffraction, were analyzed to calculate a lattice constant (a: unit is A) of austenite, and the average concentration (c: unit is mass %) of C in austenite was determined on the basis of the following Expression (2).

$$c=(a-3.572)/0.033 \quad (2)$$

(Structure Uniformity) The hardness at five points under a load of 1 kg was measured by using a Vickers tester, and evaluation was made by setting a difference between the maximum value and the minimum value of the Vickers hardness as the structure uniformity.

(Tensile Test)

A tensile test specimen of No. JIS 5 having a thickness of 2.0 mm was collected from steel after the heat treatment, and a tensile test was performed in conformity to JIS Z2241 to measure TS (tensile strength) and EL (total elongation). In addition, TS×EL was calculated from TS and EL.

(Impact Characteristics)

Front and rear surfaces of the steel after the heat treatment were grinded to have a thickness of 1.2 mm, and a V-notched test specimen was prepared. Four sheets of the test specimen were laminated and were fixed with a screw, and the resultant laminated sheets were provided to a Charpy impact test in conformity to JIS Z2242. With regard to impact characteristics, a case where an impact value at 0° C. became 20 J/cm$^2$ or greater was regarded as "Good", and a case where an impact value at 0° C. was less than 20 J/cm$^2$ was regarded as "Poor".

TABLE 1

| Steel | Chemical composition (mass %), remainder: Fe and impurities | | | | | | | | $Ac_3$ |
|---|---|---|---|---|---|---|---|---|---|
| Symbol | C | Si | Mn | P | S | sol. Al | N | Other | (° C.) |
| A | 0.23 | 1.68 | 3.31 | 0.012 | 0.0013 | 0.035 | 0.0042 | — | 811 |
| B | 0.074 | 1.76 | 5.25 | 0.012 | 0.0013 | 0.029 | 0.0043 | Ca: 0.0013 | 796 |
| C | 0.14 | 1.73 | 4.21 | 0.010 | 0.0011 | 0.034 | 0.0035 | REM: 0.0021 | 806 |
| D | 0.035 | 1.56 | 6.98 | 0.012 | 0.0011 | 0.032 | 0.0051 | — | 754 |
| E | 0.11 | 1.96 | 4.92 | 0.010 | 0.021 | 0.031 | 0.0039 | — | 802 |
| F | 0.095 | 1.87 | 3.64 | 0.012 | 0.0014 | 0.035 | 0.0042 | Ni: 0.87 | 831 |
| G | 0.092 | 2.05 | 4.95 | 0.012 | 0.0013 | 0.028 | 0.0041 | Mg: 0.0014<br>Bi: 0.0016 | 811 |
| H | 0.10 | 3.25 | 6.31 | 0.012 | 0.0013 | 0.028 | 0.0042 | — | 821 |
| I | 0.098 | 1.43 | 4.26 | 0.009 | 0.0012 | 0.028 | 0.0046 | Cu: 0.32<br>Ni: 0.45<br>Zr: 0.0012 | 787 |
| J | 0.10 | 2.02 | 4.84 | 0.011 | 0.0011 | 0.029 | 0.0048 | V: 0.024<br>B: 0.0007 | 813 |
| K | 0.097 | 0.24 | 3.35 | 0.009 | 0.0009 | 0.030 | 0.0044 | — | 775 |
| L | 0.52 | 1.26 | 3.13 | 0.011 | 0.0011 | 0.028 | 0.0045 | — | 745 |
| M | 0.15 | 1.89 | 4.64 | 0.012 | 0.0014 | 0.031 | 0.0045 | Ti: 0.015<br>Nb: 0.022<br>Cr: 0.43 | 793 |
| N | 0.10 | 1.98 | 4.97 | 0.010 | 0.0011 | 0.028 | 0.0041 | — | 803 |
| O | 0.23 | 1.43 | 1.02 | 0.012 | 0.0012 | 0.037 | 0.0041 | — | 869 |
| P | 0.11 | 1.52 | 4.42 | 0.011 | 0.0009 | 0.23 | 0.0042 | Mo: 0.12 | 881 |
| Q | 0.12 | 0.75 | 4.63 | 0.013 | 0.0012 | 0.032 | 0.0042 | — | 756 |
| R | 0.25 | 1.12 | 2.52 | 0.016 | 0.0012 | 0.031 | 0.0039 | — | 807 |
| S | 0.32 | 2.03 | 4.89 | 0.011 | 0.0009 | 0.034 | 0.0047 | — | 761 |
| T | 0.11 | 1.34 | 5.01 | 0.013 | 0.0007 | 0.55 | 0.0033 | — | 981 |
| U | 0.10 | 2.42 | 7.82 | 0.011 | 0.0008 | 0.042 | 0.0036 | — | 808 |

(Remark) an underline represents that a value is not in a range of the invention

TABLE 2

| Sample No. | Steel symbol | Metallographic structure | Average grain size of prior austenite (μm) |
|---|---|---|---|
| 1 | A | Martensite single phase | 11 |
| 2 | A | Austenite and bainite plural phases | 12 |
| 3 | B | Martensite single phase | 15 |
| 4 | C | Martensite single phase | 13 |
| 5 | C | Martensite single phase | 25 |
| 6 | D | Martensite single phase | 14 |
| 7 | E | Martensite single phase | 11 |
| 8 | F | Martensite single phase | 12 |
| 9 | F | Martensite single phase | 15 |
| 10 | G | Martensite single phase | 13 |
| 11 | H | Martensite single phase | 15 |
| 12 | I | Martensite single phase | 12 |
| 13 | I | Martensite single phase | 14 |
| 14 | J | Martensite single phase | 13 |
| 15 | J | Martensite single phase | 12 |
| 16 | K | Martensite single phase | 11 |
| 17 | L | Martensite single phase | 12 |
| 18 | M | Martensite single phase | 13 |
| 19 | M | Martensite single phase | 12 |
| 20 | N | Martensite single phase | 14 |
| 21 | N | Martensite single phase | 15 |
| 22 | O | Martensite single phase | 11 |
| 23 | P | Martensite single phase | 12 |
| 24 | Q | Martensite single phase | 13 |
| 25 | R | Martensite single phase | 11 |
| 26 | S | Martensite single phase | 12 |

TABLE 2-continued

| Sample No. | Steel symbol | Metallographic structure | Average grain size of prior austenite (μm) |
|---|---|---|---|
| 27 | T | Martensite single phase | 11 |
| 28 | U | Martensite single phase | 13 |

(Remark)
an underline represents that a value is not in a range of the invention

TABLE 3

| Sample No. | Average heating rate (° C./s) | Retention temperature (° C.) | Retention time (second) | Cooling rate (° C./s) |
|---|---|---|---|---|
| 1 | 10 | 700 | 30 | 50 |
| 2 | 10 | 700 | 30 | 50 |
| 3 | 10 | 710 | 30 | 50 |
| 4 | 10 | 720 | 30 | 50 |
| 5 | 10 | 680 | 15 | 50 |
| 6 | 10 | 680 | 30 | 50 |
| 7 | 10 | 700 | 30 | 50 |
| 8 | 10 | 720 | 30 | 50 |
| 9 | 10 | 680 | 30 | 3 |

TABLE 3-continued

| Sample No. | Average heating rate (° C./s) | Retention temperature (° C.) | Retention time (second) | Cooling rate (° C./s) |
|---|---|---|---|---|
| 10 | 10 | 700 | 30 | 50 |
| 11 | 10 | 700 | 30 | 50 |
| 12 | 10 | 700 | 30 | 50 |
| 13 | 10 | 800 | 30 | 50 |
| 14 | 10 | 700 | 30 | 50 |
| 15 | 10 | 790 | 30 | 50 |
| 16 | 10 | 690 | 30 | 50 |
| 17 | 10 | 700 | 30 | 50 |
| 18 | 10 | 700 | 30 | 30 |
| 19 | 10 | 660 | 30 | 30 |
| 20 | 10 | 700 | 30 | 50 |
| 21 | 10 | 700 | 1500 | 50 |
| 22 | 10 | 730 | 30 | 50 |
| 23 | 10 | 700 | 30 | 50 |
| 24 | 10 | 700 | 30 | 50 |
| 25 | 10 | 740 | 30 | 50 |
| 26 | 10 | 680 | 95 | 50 |
| 27 | 10 | 760 | 10 | 50 |
| 28 | 10 | 700 | 30 | 50 |

(Remark)
an underline represents that a value is not in a range of the invention

TABLE 4

| Sample No. | Steel symbol | Volume ratio of austenite (%) | Average concentration of C in austenite (% mass %) | Structure uniformity (Hv) | TS (MPa) | EL (%) | TS × EL (MPa · %) | Impact characteristics | Remark |
|---|---|---|---|---|---|---|---|---|---|
| 1 | A | 16 | 0.56 | 29 | 987 | 25 | 24675 | Good | Invention Example |
| 2 | A | 8 | 0.52 | 21 | 954 | 19 | 18126 | Good | Comparative Example |
| 3 | B | 18 | 0.37 | 27 | 953 | 28 | 26684 | Good | Invention Example |
| 4 | C | 12 | 0.56 | 26 | 1045 | 24 | 25080 | Good | Invention Example |
| 5 | C | 13 | 0.66 | 28 | 958 | 26 | 24908 | Poor | Comparative Example |
| 6 | D | 4 | 0.37 | 25 | 768 | 20 | 15360 | Good | Comparative Example |
| 7 | E | 18 | 0.41 | 23 | 1035 | 24 | 24840 | Poor | Comparative Example |
| 8 | F | 12 | 0.39 | 25 | 994 | 25 | 24850 | Good | Invention Example |
| 9 | F | 13 | 0.56 | 24 | 894 | 30 | 26820 | Good | Comparative Example |
| 10 | G | 21 | 0.43 | 26 | 1083 | 25 | 27075 | Good | Invention Example |
| 11 | H | 13 | 0.41 | 22 | 1102 | 25 | 27550 | Poor | Comparative Example |
| 12 | I | 21 | 0.45 | 24 | 1108 | 25 | 27700 | Good | Invention Example |
| 13 | I | 5 | 0.52 | 28 | 1206 | 6 | 7236 | Good | Comparative Example |
| 14 | J | 15 | 0.39 | 26 | 1153 | 21 | 24213 | Good | Invention Example |
| 15 | J | 7 | 0.41 | 22 | 1242 | 10 | 12420 | Good | Comparative Example |
| 16 | K | 9 | 0.56 | 24 | 975 | 21 | 20475 | Good | Comparative Example |
| 17 | L | 25 | 0.73 | 25 | 1345 | 21 | 28245 | Poor | Comparative Example |
| 18 | M | 19 | 0.43 | 23 | 1225 | 20 | 24500 | Good | Invention Example |
| 19 | M | 16 | 0.64 | 24 | 895 | 29 | 25955 | Poor | Comparative Example |
| 20 | N | 20 | 0.52 | 27 | 1073 | 26 | 27898 | Good | Invention Example |
| 21 | N | 18 | 0.28 | 24 | 1042 | 24 | 25008 | Poor | Comparative Example |
| 22 | O | 8 | 0.51 | 33 | 804 | 20 | 16080 | Good | Comparative Example |
| 23 | P | 18 | 0.43 | 22 | 1105 | 25 | 27625 | Good | Invention Example |
| 24 | Q | 15 | 0.45 | 25 | 1013 | 24 | 24312 | Good | Invention Example |
| 25 | R | 6 | 0.48 | 36 | 872 | 25 | 21800 | Good | Comparative Example |
| 26 | S | 27 | 0.55 | 28 | 1289 | 23 | 29647 | Good | Invention Example |
| 27 | T | 18 | 0.48 | 27 | 1003 | 25 | 25075 | Good | Invention Example |
| 28 | U | 25 | 0.51 | 23 | 1175 | 21 | 24675 | Good | Invention Example |

(Remark) art underline represents that a value is not in a range of the invention As shown in Table 4, sample Nos. 1, 3, 4, 8, 10, 12, 14, 18, 20, 23, 24, 26, 27, and 28 according to the present invention had a tensile strength of 900 MPa or greater, and the value of the product of the tensile strength and the total elongation (TS×EL) was 24000 MPa·% or greater. According to this, it could be seen that the ductility was excellent. In addition, an impact value in the Charpy test at 0° C. was 20 J/cm$^2$ or greater, and thus it could be seen that impact characteristics were also good. Particularly, in Sample Nos. 4, 10, 12, 14, 18, 20, 23, 24, 26, 27, and 28, the amount of C and the amount of Mn were in a preferable range, and the tensile strength was very high as 1000 MPa or greater.

Furthermore, a structure other than austenite was composed of martensite.

On the other hand, in sample No. 2, the metallographic structure of steel, which was used in the heat treatment, was not appropriate, and thus the volume ratio of austenite was low and the ductility was low after the heat treatment. In sample No. 5, the grain size of prior austenite of the steel (base steel), which was used in the heat treatment, was not appropriate, and thus the average concentration of C in austenite in the steel after the heat treatment was high, and the impact characteristics were poor. In Sample Nos. 6, 22, and 25, the chemical composition was not appropriate, and thus the ductility was poor. Accordingly, a target tensile strength was not obtained. In addition, in Sample Nos. 22 and 25, the structure uniformity did not satisfy a target value. In Sample Nos. 7, 11, and 17, the chemical composition was not appropriate, and thus the impact characteristics were poor. In Sample No. 9, the cooling rate after the heat treatment was too slow, and thus a required tensile strength was not obtained. In Sample Nos. 13 and 15, the retention temperature during the heat treatment was too high, and thus a desired structure was not obtained. Accordingly, the ductility was inferior. In Sample No. 16, the chemical composition was not appropriate, and thus the ductility was inferior. In Sample No. 19, the retention temperature during the heat treatment was too low, and thus a desired structure was not obtained. Accordingly, the impact characteristics were poor, and a required tensile strength was not obtained. In Sample No. 21, the retention time during the heat treatment was too long, and thus a desired structure was not obtained. Accordingly, the impact characteristics were poor.

INDUSTRIAL APPLICABILITY

According to the present invention, it is possible to manufacture ultrahigh-strength steel excellent in ductility and impact characteristics while having a high strength such as a tensile strength of 900 MPa or greater. For example, the ultrahigh-strength steel according to the present invention can be widely used in a vehicle field, an energy field, and a building field, and thus an industrial use value thereof is high.

What is claimed is:

1. A method of manufacturing a steel, comprising:

performing a heat treatment with respect to a base steel having a metallographic structure in which an average grain size of a prior austenite is 20 μm or less and which is composed of a martensite single phase, wherein the heat treatment includes:

a retention process of retaining the base steel at a temperature that is equal to or higher than 670° C. and lower than 780° C., and is lower than an $A_{c3}$ point for 5 seconds to 120 seconds; and a cooling process of cooling the base steel in such a manner that an average cooling rate from the temperature region to 150° C. is 5 "C/second to 500° C./second after the retention process, and wherein the steel has a chemical composition comprising, by mass %:

0.050% to 0.40% of C,
0.50% to 3.0% of Si,
4.0% to 8.0% of Mn,
0.001% to 3.0% of sol. Al,
0.05% or less of P,
0,01% or less of S,
0.01% or less of N,
0% to 1.0% of Ti,
0% to 1.0% of Nb,
0% to 1.0% of V,
0% to 1.0% of Cr,
0% to 1.0% of Mo,
0% to 1.0% of Cu,
0% to 1.0% of Ni,
0% to 0.01% of Ca,
0% to 0.01% of Mg,
0% to 0.01% of REM,
0% to 0.01% of Zr,
0% to 0.01% of B,
0% to 0.01% of Bi, and
the remainder including Fe and impurities.

* * * * *